US005277764A

United States Patent [19]

Johansson et al.

[11] Patent Number: 5,277,764

[45] Date of Patent: Jan. 11, 1994

[54] PROCESS FOR THE PRODUCTION OF CELLULOSE FIBRE CONTAINING PRODUCTS IN SHEET OR WEB FORM

[75] Inventors: Kjell Johansson, Mölnlycke; Hans E. Johansson; Stefan Klöfver, both of Kungälv, all of Sweden

[73] Assignee: Eka Nobel AB, Bohus, Sweden

[21] Appl. No.: 803,970

[22] Filed: Dec. 9, 1991

[30] Foreign Application Priority Data

Dec. 11, 1990 [SE] Sweden ..... 9003954

[51] Int. Cl.[5] ..... D21H 17/24

[52] U.S. Cl. ..... 162/175; 162/178; 162/181.1; 162/181.2; 162/181.6; 162/183

[58] Field of Search ..... 162/175, 178, 181.6, 162/181.1, 181.2, 181.3, 183

[56] References Cited

U.S. PATENT DOCUMENTS

| | | | |
|---|---|---|---|
| 4,385,961 | 5/1983 | Svending et al. | 162/175 |
| 4,388,150 | 6/1983 | Sunden et al. | 162/175 |
| 4,940,784 | 7/1990 | Stober et al. | 536/1.1 |
| 4,981,958 | 1/1991 | Stober et al. | 586/45 |
| 5,127,994 | 7/1992 | Johansson | 162/168.3 |

FOREIGN PATENT DOCUMENTS

| | | |
|---|---|---|
| 041056 | 8/1984 | European Pat. Off. . |
| 233336 | 8/1987 | European Pat. Off. . |
| 234513 | 9/1987 | European Pat. Off. . |
| 235893 | 9/1987 | European Pat. Off. . |
| 303039 | 2/1989 | European Pat. Off. . |
| 303040 | 2/1989 | European Pat. Off. . |
| 335575 | 10/1989 | European Pat. Off. . |
| 348366 | 12/1989 | European Pat. Off. . |
| 359552 | 3/1990 | European Pat. Off. . |
| WO86/00100 | 1/1986 | PCT Int'l Appl. . |
| WO89/06637 | 7/1989 | PCT Int'l Appl. . |
| WO89/12661 | 12/1989 | PCT Int'l Appl. . |
| WO91/07350 | 5/1991 | PCT Int'l Appl. . |
| WO91/07351 | 5/1991 | PCT Int'l Appl. . |

*Primary Examiner*—Peter Chin

*Attorney, Agent, or Firm*—Burns, Doane, Swecker & Mathis

[57] ABSTRACT

Cellulose fibre containing products in sheet or web form, such as paper and pulp sheets, are produced from a suspension of cellulose containing fibres, and optional fillers, to which is added anionic inorganic particles, such as bentonite and silica based particles, and a cationic carbohydrate polymer containing aluminum. The cationic carbohydrate polymers are cationic galactomannans or cationic starch. High cationized starch with a degree of substitution of at least 0.07 are especially suitable.

12 Claims, No Drawings

PROCESS FOR THE PRODUCTION OF CELLULOSE FIBRE CONTAINING PRODUCTS IN SHEET OR WEB FORM

The present invention relates to a process for the production of cellulose fibre containing products in sheet or web form, especially paper, whereby anionic inorganic particles and a cationic polymer are used for improving retention and dewatering. More particularly the invention relates to use of anionic inorganic particles in combination with a cationic carbohydrate polymer which contains aluminum as a retention and dewatering system in this production.

It is known to use combinations of cationic carbohydrate polymers, particularly cationic starch but also cationic guar gum, and anionic inorganic particles, such as bentonite and different types of silica sols, in the production of paper in order to improve retention and/or dewatering. For cationic carbohydrate polymers the degree of substitution, DS, is often given as a measure of the cationic charge. DS gives the average number of positions per glucose unit having cationic substituent groups. Commercially cationic starch of lower cationicity has usually been used. The European patent 41056 describes use of cationic starch in combination with silica sol and the PCT application WO 86/00100 describes use of cationic starch or cationic guar gum in combination with aluminum modified silica sol. In both these documents it is stated that the best results are obtained when the cationic starch has a degree of substitution between 0.01 and 0.05 and the last mentioned document states as a general degree of substitution 0.01 to 0.1. In the European patent application 234513 the use of cationic starch, silica sol and a high molecular anionic polymer is described and in the application it is generally stated that the starch has a degree of substitution of from 0.01 to 0.20 while according to the examples cationic starch having a degree of substitution of 0.025 is used. The European patent application 335575 suggests use of a cationic starch without further specification, a cationic synthetic polymer and bentonite or colloidal silica in special steps at papermaking. The PCT application WO 89/12661 discloses use of cationic starch in combination with colloidal clay of smectite type, particularly hectorite and bentonite, and for the cationic starch it is stated that the degree of substitution should be above 0.03 and preferably be within the range of 0.035 to 0.05.

According to the present invention it has been found that surprisingly good retention and dewatering results in the production of cellulose fibre containing products in sheet or web form are obtained when anionic inorganic particles are used in combination with a cationic carbohydrate polymer, which is a cationic starch containing aluminum or a cationic galactomannan containing aluminum.

The present invention thus relates to a process for the production of cellulose fibre containing products in sheet or web form from a suspension of cellulose containing fibres, and optional fillers, which comprises forming and dewatering of the suspension on a wire and drying whereby anionic inorganic particles and a cationic carbohydrate polymer, as further defined in the claims, are added to the suspension.

The cationic carbohydrate polymer used according to the present invention is a cationic starch or a cationic galactomannan and it has a degree of substitution of at least 0.02 and contains at least 0.01 percent by weight of aluminum. The cationic carbohydrate polymer can have a degree of substitution of up to 1.0. The aluminum content is suitably at least 0.02 percent by weight and the preferred range is from 0.05 to 5 percent by weight and especially from 0.1 to 1.5. Cationic starch and cationic galactomannans containing aluminum are previously known and a method for their preparation is disclosed in the European patent application 303039 and European patent application 303040, respectively. The fact that the carbohydrate polymer used in the method of the invention contains aluminum means that the aluminum is bound in the actual molecules of the carbohydrate polymer. It is not entirely clear how the aluminum is bound, but a theory is that the aluminum in the form of aluminate ions is complex bound to the molecules. The base starch in the cationized starch can be any such starch, such as potato, wheat, corn, barley, oat, rice and tapioca starch and mixtures of different types of starch. The preferred cationic galactomannan is cationic guar gum and it is especially preferred that the cationic carbohydrate polymer is cationic starch, having above given suitable and preferred aluminum contents and degrees of substitution. According to the processes disclosed in European patent application 303039 and European patent application 303040, respectively, which are hereby incorporated in this application by reference, starch and galactomannan, such as guar gum, are dry cationized with nitrogen containing alkylenepoxides in the presence of a finely divided hydrophobic silicic acid and an alkaline substance which, among others, can be alkali aluminate. Advantageously cationic starch prepared using alkali aluminate as disclosed in the European patent application 303039 is used in the present process.

A preferred embodiment of the present invention relates to the use of cationic starch or cationic galactomannan containing aluminum, as above, and having a high degree of substitution, of at least 0.07. The carbohydrate polymers of high cationicity can have degrees of substitution of up to 1.0 and the degree of substitution is suitably within the range of from 0.1 to 0.6. Cationic starch having these degrees of substitution are particularly preferred. The retention and dewatering results obtained with the high cationized aluminum containing starches are substantially better than the results obtained with a cationic starch having a lower degree of substitution, which does not contain aluminum, used in amounts which contribute to the corresponding number of cationic charges as when the high cationized starch containing aluminum is used. The results are also substantially better compared to cationic starch having the same degree of substitution but not containing aluminum.

The cationic carbohydrate polymer is, as conventionally, added to the fibre suspension in the form of an aqueous solution. Aqueous solutions of cationic galactomannan, such as guar gum, are conventionally prepared by dissolution in cold water. Aqueous solutions of the cationic starch used according to the present invention can be prepared by conventional cooking of the starch when this has a lower degree of substitution, up to about 0.07. For very high cationized starch, with degrees of substitution of about 0.12 and higher, dissolution in cold water can also be used for the preparation of the starch solution. It is preferred to use cooked starch as it has been found that this gives an optimum effect at a lower dosage than when the starch has been dissolved in cold water. Cooking is also preferred from technical aspects and with regard to handling. According to a particularly preferred embodiment starch solutions are used which have been prepared by the process described in the following. According to this process particles of the cationized starch are mixed with cold water and subjected to shearing forces so that any agglomerates present are disintegrated and each separate particle is wetted, whereafter the mixture is heated to at least about 60° C., and preferably to at least 100° C., and is kept in heated condition until viscosity maximum has been passed. It is suitable to subject the mixture of the cationized starch and cold water to shearing forces in an equipment of the Gorator (R) type, wherein the mixture can be subjected to comparatively high shearing forces so that breaking up of agglomerates and wetting can be carried out in very short times, within about 5 minutes and preferably within about one minute. The mixture is then immediately heated, preferably within about 1 minute. Even the heat treatment should be of very short duration and preferably not last longer than 5 minutes and it is suitably carried out in a jet cooker under pressure to avoid boiling. This method is particularly preferred for high cationized starch. Independent of the method for dissolution the obtained aqueous solutions of cationic starch are normally diluted to a solids content within the range of from about 0.1 to about 3 percent by weight before they are added to the fibre suspension. The solutions of the aluminumcontaining starch can have a pH of 4 to 10, measured on a 2% solution, and preferably from 6 to 8.

The anionic inorganic particles which are used are previously known for use in papermaking. As examples of such can be mentioned swellable colloidal clays such as bentonite and clays of bentonite type, e.g. montmorillonite, titanyl sulphate and different silica based particles. Bentonites and silica based particles are preferred. The anionic inorganic particles are added to the cellulose fibre containing suspension in the form of aqueous dispersions.

Bentonites such as disclosed in the European patent application 235893 are suitable. Dispersions of bentonite are suitably prepared by dispersion of bentonite in powder form in water whereby the bentonite swells and gets a high surface area, usually within the range of from 400 to 800 $m^2g$. The concentration of bentonite in the dispersion added to the fibre suspension is usually within the range of from 1 to 10 percent by weight.

Silica based particles, i.e. particles based on $SiO_2$, which can be used in the present process comprise colloidal silica and colloidal aluminum modified silica or aluminum silicate and different types of polysilicic acid. These are added to the cellulose fibre suspension in the form of colloidal dispersions, so called sols. Since the particles have a large surface area in comparison with their volume particles in colloidal dispersions do not sediment by gravity. Suitable silica based sols are such which are disclosed in the above mentioned European patent 41056 and PCT application WO 86/00100. The colloidal silica in these sols preferably has a specific surface area of 50 to 1000 $m^2/g$ and more preferably of from about 100 to 1000 $m^2/g$. Sols of this type are usually used commercially and with particles having a specific surface area of about 400 to 600 $m^2/g$ and the average particle size is usually below 20 nm and most often from about 10 down to about 1 nm. Another suitable silica sol is a sol having an S-value within the range of from 8 to 45 percent and which contains silica particles having a specific surface area within the range of from 750 to 1000 $m^2/g$ and which particles are surface modified with aluminum to a degree of from 2 to 25 percent. In contrast to the above described commercial sols these sols have a comparatively low S-value. The S-value is a measure of the degree of aggregate or microgel formation and a low S-value indicates a larger amount of microgel and can also be regarded as a measure of the $SiO_2$-content in the dispersed phase. These sols are disclosed in the PCT application WO 91/07350, which is hereby incorporated herein by reference. The sols with low S-values can be prepared starting from a diluted solution of a conventional alkali water glass, suitably having an $SiO_2$ content of from about 3 to about 12 percent by weight, which is acidified to a pH of from about 1 to about 4. The acid sol obtained after acidification is then alkalized, preferably by addition of water glass, suitably to a pH of at least 8 and most suitably within the range of from 8 to 11, and suitably to a final molar ratio $SiO_2$ to $M_2O$ within the range of from about 20:1 to about 75:1. At the production of sol as disclosed the degree of microgel can be influenced in different ways and be controlled to a desired low value. The degree of microgel can be influenced by salt content, by adjustment of the concentration at the preparation of the acid sol and at the alkalization since the degree of microgel is here influenced when the stability minimum for the sol is passed, at a pH of about 5. By extended times at this passage the degree of microgel can thus be controlled to desired value. It is particularly suitable to control the degree of microgel by adjusting the dry content, the $SiO_2$ content, at the alkalization whereby a higher dry content gives a lower S-value. After the alkalization a particle growth starts and thereby a decrease of the specific surface area and thus a growth process is carried out so that the desires specific surface area is obtained and this surface area is then stabilized by aluminum modification in per se known manner. Another type of silica based sol which can be used has a comparatively low molar ratio $SiO_2$ to $M_20$, where M is alkali metal ion and/or ammonium ion, within the range of from 6:1 to 12:1 and which contains silica particles having a specific surface area within the range of from 700 to 1200 $m^2/g$. Such sols are disclosed in the PCT application WO 91/07351, which is likewise incorporated herein by reference. Suitable sols based on polysilicic acid, by which is meant that the silicic acid material is present in the form of very small particles, of the order 1 nm, with a very high specific surface area, above 1000 $m^2/g$ and up to about 1700 $m^2/g$, and with a certain degree of aggregate or microgel formation are disclosed in the European patent application 348366, the European patent application 359552 and the PCT application WO 89/06637.

From practical aspects it is suitable that the silica based sols added to the stock have a concentration of from 0.05 to 5.0 percent by weight. For sols based on polysilicic acid the concentration should be low in order to avoid gelling and suitably it does not exceed 2 percent by weight.

The amount of anionic inorganic colloidal particles added to the fibre suspension should be at least 0.01 kg/ton, calculated as dry on dry fibres and optional fillers. Suitable amounts are within the range of from 0.1 to 5 kg/ton and preferably within the range from 0.1 to 3 kg/ton. The cationic carbohydrate polymer is usually used in amounts of at least 0.1 kg/ton, calculated as dry on dry fibres and optional fillers. Suitably amounts of from 0.5 to 50 kg/ton and preferably from 1 to 20 kg/ton are used. Usually the weight ratio of the cationic carbohydrate polymer to the inorganic material should be at least 0.01:1 and suitably at least 0.2:1. The upper limit for the cationic carbohydrate polymer is primarily decided by economy and ratios up to 100:1 can be used. It is most suitable to add the cationic carbohydrate polymer to the fibre suspension before the anionic inorganic particles, although reversed order of addition can be used.

The present invention relates to the production of cellulose fibre-containing products in sheet or web form, and hereby is primarily intended paper, including board and cardboard, and pulp sheets. At the production of these products it is important to have both as good retention of fine fibres and optional fillers as is possible and as high speed of dewatering as possible in order to be able to increase the speed of the machine. The present process gives both increased retention and increased dewatering. Pulp sheets are intended for the further production of paper. Production of pulp sheets is carried out starting from a suspension of cellulose containing fibres, normally with dry contents of from about 1 to about 6 percent by weight, which is dewatered on a wire and dried. Pulp sheets are usually free from fillers and usually no chemicals are added, except for optional retention and dewatering improving substances, at the production of the sheets. The present process is particularly suitable for the production of paper. At the production of paper a number of different chemical additives to the fibre suspension, the stock, are usually used. The stock generally has a dry content within the range of from about 0.1 to about 6 percent by weight and the suspension often contains fillers. The anionic inorganic particles and the cationic carbohydrate polymers according to the present invention can be used at the production of paper from different types of stocks of cellulose-containing fibres and the stocks should suitably contain at least 50 percent of such fibres, based on dry material. The components can for example be used as additives to stocks of fibres from chemical pulp, such as sulfate and sulfite pulp, chemi-thermomechanical pulp (CTMP), thermomechanical pulp, refiner mechanical pulp or groundwood pulp from as well hardwood as softwood and can also be used for stocks based on recycled fibres. The stocks can also contain mineral fillers of conventional kinds, such as for example kaolin, titanium dioxide, gypsum, chalk and talcum. Particularly good results have been obtained at the use of aluminum containing starch having a high degree of substitution together with anionic inorganic particles for stocks which are usually considered as difficult. Examples of such stocks are those containing mechanical pulp, such as groundwood pulp, stocks based on recycled fibres and stocks which contain high amounts of anionic impurities such as lignin and dissolved organic compounds and/or high amounts of electrolytes. The combination according to the invention with high cationized aluminum-containing starch is particularly suitable for stocks containing from at least 25 percent by weight of mechanical pulp. The paper production according to the invention can be carried out within a wide pH range, from about 3.5 to about 10. Good results have also been noticed at paper production from stocks of lower pH values, from about 3.5 to about 6, particularly when alum is used, where it has earlier been much more difficult to obtain good retention and dewatering in comparison with alkaline stocks.

Both at the production of pulp sheets and paper additional cationic retention agents can be used, for example cationic polyacrylamides, polyethyleneimines, poly(-diallyldimethylammonium chloride) and polyamidoamines.

At the production of paper according to the present invention other paper chemical additives, that are commonly used, can of course also be used, such as hydrophobing agents, dry strength agents, wet strength agents etc. It is particularly suitable to use aluminum compounds as additives to the stock to further increase the retention and dewatering effects. Any at paper production per se known aluminum compound can be used, for example alum, aluminates, aluminum chloride, aluminum nitrate and polyaluminum compounds such as polyaluminum chloride, polyaluminum sulphate and polyaluminum compounds containing both chloride and sulphate ions.

The invention is further illustrated in the following examples which, however, are not intended to limit the same. Parts and percent relate to parts by weight and percent by weight, respectively, unless otherwise stated.

Example 1

In this example the retention of fillers and fine fibres was measured. The stock was a standard stock with 70% of a 60/40 mixture of bleached birch sulphate pulp and bleached pine sulphate pulp and with 30% of chalk. 0.3 g/l of $Na_2SO_4.10H_2O$ had been added to the stock which had a pH of 4.5. The stock concentration was 5.0 g/l and the fine fraction content was 38.6%. For measuring the retention a baffled "Britt Dynamic Drainage Jar" was used, and this is the conventional method for evaluating retention in the paper industry. The speed of agitation was set to 1000 rpm.

The anionic inorganic material was an aluminum modified silica sol of the type disclosed in the PCT application WO 86/00100. The sol was alkali stabilized to a molar ratio $SiO_2$:$Na_2O$ of about 40. The particles had a specific surface area of 500 $m^2/g$ and 9% of the silicon atoms in the surface groups had been replaced by aluminum atoms. The sol was added to the stock in an amount corresponding to 2 kg dry substance per ton of dry stock system (fibres+fillers). The cationic starch used was one having a degree of substitution of 0.18 and containing aluminum in an amount of 0.3% by weight (Starch A) and one having the same degree of substitution but not containing aluminum (Starch B). The two starches had been prepared according to the process disclosed in the European patent application 303039 whereby the cationization had been carried out in the presence of aluminate for starch A but without aluminate for starch B. In all tests 10 kg of alum per ton of fibres and fillers were also added separately to the stock. The order of addition for the chemicals was alum, cationic starch, silica sol. When only alum was added to the stock the retention was 10.8%. The results are shown in the table below.

| Test No | Starch A kg/ton | Starch B kg/ton | Retention % |
|---|---|---|---|
| 1 | 6 | — | 61.2 |
| 2 | 9 | — | 78.5 |
| 3 | 12 | — | 78.5 |
| 4 | — | 6 | 33.9 |
| 5 | — | 9 | 28.0 |

-continued

| Test No | Starch A kg/ton | Starch B kg/ton | Retention % |
|---|---|---|---|
| 6 | — | 12 | 21.8 |

As evident a substantial improvement of the retention is obtained with starch A containing aluminum in comparison with starch B which has the same degree of substitution but does not contain aluminum.

Example 2

In this example the retention of fines was measured in the same manner as in example 1. The stock was a recycled fibre stock [with the composition 37% OCC (old corrugated cardboard), 55% news and 6% mixed] and had a pH of 7.8. The fine fraction content was 38.5%. The calcium ion content in the aqueous phase was 150 ppm and the COD value 800 mg $O_2$/l. The same silica sol as in example 1 was used and added in an amount of 2 kg per ton dry stock. Two cationic starches were used: Starch C with a degree of substitution of 0.15 and an aluminum content of 0.3% and starch D, a conventional low cationized starch which does not contain aluminum, sold under the name of Raisamyl 142. This starch has a degree of substitution of 0.042 which means that starch C has about 3.6 times as many cationic charges as starch D.

| Test No | Starch C kg/ton | Starch D kg/ton | Retention % |
|---|---|---|---|
| 1 | 8 | — | 84 |
| 2 | 10 | — | 86 |
| 3 | — | 8 | 71 |
| 4 | — | 10 | 71 |
| 5 | — | 25 | 61 |
| 6 | — | 30 | 60 |

These tests show that the starch utilized according to the present invention gives a better effect than the earlier conventionally used starch. They also show that even if the amount of the latter is increased to give about the same number of added charges as with the high cationized aluminum containing starch improved results are not obtained.

Example 3

In this example a stock based on recycled fibres was used and the retention was evaluated according to the above given method. The pH of the pulp was 6, the conductivity was 2900 μS/cm, the Ca-ion content was 290 ppm and the COD value was 1800 mg $O_2$/l. The fine fraction content was 34.5%. 2 kg/ton of the same silica sol as in example 1 was used and the cationic starch had a degree of substitution of 0.18 and an aluminum content of about 0.3 percent. The tests were made in order to evaluate any differences between cooked starch and starch dissolved in cold water. In these tests the cooked starch gave optimum retention, 70%, at a dosage of 8 kg/ton while optimum retention, 72%, for the cold water dissolved starch was not reached until the dosage was 15 kg/ton.

Example 4

In this example the dewatering effect was evaluated by means of a "Canadian Standard Freeness (CSF) Tester", which is the conventional method for characterization of dewatering or drainage capability, according to SCAN-C 21:65. All additions of chemicals were made at a mixing speed of 800 rpm in a baffled "Britt Dynamic Drainage Jar" with blocked outlet during 45 seconds and the stock system was then transferred to the Canadian Standard Freeness Tester apparatus.

The stock was based on a pulp mixture of 50% CTMP, 30% unbleached sulphate pulp and 20% broke from a paper board mill. The concentration was 4 g/l and the pH was 7.5. The CSF value when no chemicals had been added was 390 ml.

Different anionic inorganic materials were used in the tests: a) An anionic silica sol of the type disclosed in the European patent 41056, below designated as BMA-0. The sol was alkali stabilized to a molar ratio $SiO_2$:$Na_2O$ of about 40 and the particles had a specific surface area of 500 $m^2$/g. b) An anionic silica sol with comparatively low S-value, about 25, a specific surface area of about 900 $m^2$/g and aluminum modified to a degree of 5%, below designated as BMA-590. c) A polysilicic acid of the type disclosed in the European patent application 348366 with a specific surface area of about 1450 $m^2$/g, below designated as PSA. d) Bentonite. The inorganic materials were in all the tests added in amounts corresponding to 1 kg/ton, calculated as dry on dry stock.

The cationic starches were: A: A cationic starch having a degree of substitution of 0.12 and containing 0.4 percent by weight of aluminum, B: The corresponding cationic starch which did not contain aluminum, C: A conventional low cationized starch, Raisamyl 142, with a degree of substitution of 0.042. These are in the table below designated as CS-A, C-B and CS-C respectively.

In certain tests, as indicated in the table below, the cationic starch was used in combination with cationic polyacrylamide (PAM) and in certain tests alum was separately added to the stock in an amount of 1.5 kg/ton. The cationic starch was added to the stock before the anionic inorganic material and when alum was added it was added before the other chemicals. When cationic PAM was used it was added to the stock after the starch but before the inorganic material. Table 1 shows the result with starch CS-A according to the invention and table 2 shows the results with starches CS-B and CS-C.

TABLE 1

| Test No. | Alum kg/t | CS-A kg/t | PAM kg/t | BMA-0 kg/t | BMA-590 kg/t | PSA kg/t | Bentonite kg/t | CSF ml |
|---|---|---|---|---|---|---|---|---|
| 1 | — | 2 | — | 1.0 | — | — | — | 540 |
| 2 | — | 4 | — | 1.0 | — | — | — | 585 |
| 3 | — | 6 | — | 1.0 | — | — | — | 595 |
| 4 | — | 2 | — | — | 1.0 | — | — | 575 |
| 5 | — | 4 | — | — | 1.0 | — | — | 615 |
| 6 | — | 6 | — | — | 1.0 | — | — | 620 |
| 7 | 1.5 | 4 | — | 1.0 | — | — | — | 585 |
| 8 | 1.5 | 4 | — | — | 1.0 | — | — | 605 |
| 9 | 1.5 | 4 | — | — | — | 1.0 | — | 620 |
| 10 | 1.5 | 4 | — | — | — | — | 1.0 | 565 |

TABLE 1-continued

| Test No. | Alum kg/t | CS-A kg/t | PAM kg/t | BMA-0 kg/t | BMA-590 kg/t | PSA kg/t | Bentonite kg/t | CSF ml |
|---|---|---|---|---|---|---|---|---|
| 11 | 1.5 | 4 | 0.3 | 1.0 | — | — | — | 600 |
| 12 | 1.5 | 4 | 0.3 | — | 1.0 | — | — | 625 |
| 13 | 1.5 | 4 | 0.3 | — | — | 1.0 | — | 640 |
| 14 | 1.5 | 4 | 0.3 | — | — | — | 1.0 | 610 |

TABLE 2

| Test No. | CS-B kg/t | CS-C kg/t | BMA-O kg/t | CSF ml |
|---|---|---|---|---|
| 15 | 2 | — | 1.0 | 500 |
| 16 | 4 | — | 1.0 | 540 |
| 17 | 6 | — | 1.0 | 550 |
| 18 | — | 5.7 | 1.0 | 490 |
| 19 | — | 11.4 | 1.0 | 570 |
| 20 | — | 17.1 | 1.0 | 570 |

As evident from a comparison between the tests 1, 2 and 3 and the tests 15, 16 and 17 a considerable improvement of the dewatering effect can be obtained when the cationic starch contains aluminum. In the tests 18, 19 and 20 the low cationized starch C has been added in amounts which give corresponding number of charges as at addition of the high cationized starch A containing aluminum in the tests 1, 2 and 3. As evident the dewatering effects obtained according to the present invention cannot be obtained by increasing the amount of a conventionally used low cationized starch.

Example 5

In this example the dewatering effect was evaluated in the same manner as in example 4. The stock was based on 70% of a 60/40 mixture of bleached birch sulphate pulp and bleached pine sulphate pulp and 30% chalk. The pH of the stock was 7 and the concentration was 4.85 g/l. Further 1 g/l of $Na_2SO_4.10H_2O$ had been added. In all tests alum was first added to the stock in an amount of 1 kg/t, based on dry fibres and fillers. The anionic inorganic substance used was a commercial silica sol described in the European patent 41056, with a specific surface area of about 500 $m^2/g$ and alkali stabilized to a molar ratio $SiO_2$:$Na_2O$ of about 40:1. The sol was added in an amount of 2 kg/t, calculated as dry on dry fibres and fillers. A comparison was made between cationic starch having a degree of substitution of 0.042 containing 0.15 and 0.3% of aluminum, respectively, and a starch with the same degree of substitution but not containing aluminum. The results shown in the table below are in ml CSF.

| Starch containing dosage kg/ton | 0% Al | 0.15% Al | 0.3% Al |
|---|---|---|---|
| 6 | 440 | 490 | 505 |
| 9 | 480 | 540 | 595 |
| 12 | 500 | 550 | 605 |

Example 6

In this example a comparison of retention was made when using cationic starch having a degree of substitution of 0.042 and an aluminum content of 0.3% and a cationic starch with the same degree of substitution but not containing aluminum. The stock corresponded to that of example 5, with the only difference being that only 0.3 g/l of $Na_2SO_4.10H_2O$ has been added. The fine fraction content was 39.1%. In these tests no separate addition of alum to the stock was made. The same silica sol as that in example 5 was used and it was added in an amount of 2 kg/ton. The retention was measured as described in example 1. In the table below the results given are % retention.

| Starch containing dosage kg/t | 0% Al | 0.3% Al |
|---|---|---|
| 6 | 49.5 | 66.3 |
| 9 | 55.4 | 80.2 |
| 12 | 56.9 | 76.0 |

Example 7

In this example the retention of fines was measured in the same manner as in Example 1. The stock was a recycled fibre stock [with the composition 40% OCC (old corrugated cardboard) and 60% news] and has a pH of 8.1. The stock concentration was 5 g/l and the fine fraction content was 28.1%. The COD value of the stock was 750 and the conductivity was 800 μS/cm.

A polymeric silicic acid (PSA) of the type disclosed in EP 348366 was used. The polymeric sicilic acid had been prepared by ion exchange of water glass and had a specific surface area of about 1250 $m^2/g$. The polysilicic acid was added in an amount of 1 kg/ton dry stock and added after the cationic starch. The cationic starch used was one having a degree of substitution of 0.15 and containing aluminum in an amount of 0.3% by weight (Starch A) and one having the same degree of substitution but not containing aluminum (Starch B). When alum or sodium aluminate were added to the stock, they were added in an amount of 0.15 kg/ton calculated as $Al_2O_3$ and added before the cationic starch. The results are shown in the Table below.

| Alum kg/t | Aluminate kg/t | Starch A kg/t | Starch B kg/t | PSA kg/t | Retention % |
|---|---|---|---|---|---|
| — | — | 9 | — | 1 | 72.5 |
| 0.15 | — | 9 | | 1 | 75.0 |
| — | 0.15 | 9 | — | 1 | 74.0 |
| — | — | — | 9 | 1 | 46.9 |
| 0.15 | — | — | 9 | 1 | 57.6 |
| — | 0.15 | — | 9 | 1 | 60.0 |

This example shows that a considerably improved retention effect was obtained with a combination of polymeric silicic acid and cationic starch containing aluminum in comparison with polymeric silicic acid and cationic starch which did not contain aluminum and this also when the latter system was used with separate addition to the stock of an aluminum compound.

We claim:

1. A process for the production of cellulose fiber containing products in a sheet or web form from a suspension of cellulose containing fibers, and optional fillers, comprising the addition of anionic, inorganic, colloidal particles and cationic carbohydrate polymer to the suspension, forming of the suspension on a wire and drying, wherein the cationic carbohydrate polymer is a cationic starch or a cationic galactomannan having a degree of substitution of at least 0.02 and containing at least 0.01 percent by weight of the aluminum which aluminum is bound in the molecules of the carbohydrate polymer.

2. A process according to claim 1, wherein the cationic carbohydrate polymer is cationic starch.

3. A process according to claim 1, wherein the cationic carbohydrate polymer is cationic guar gum.

4. A process according to claim 1, wherein the cationic carbohydrate polymer has a degree of substitution of at least 0.07.

5. A process according to claim 4, wherein the cationic carbohydrate polymer has a degree of substitution of from 0.07 to 1.0.

6. A process according to claim 1, wherein the cationic carbohydrate polymer contains from 0.05 to 5 percent by weight of aluminum.

7. A process according to claim 7, wherein the anionic inorganic particles are silica based particles.

8. A process according to claim 7, wherein the anionic inorganic particles are colloidal silica, colloidal aluminum modified silica, colloidal aluminum silicate or polysilicic acid.

9. A process according to claim 1, wherein the anionic inorganic particles are bentonite.

10. A process according to claim 1, wherein the cationic carbohydrate polymer is added to the suspension in an amount of at least 0.1 kg per ton, calculated as dry on dry fibers and optional fillers.

11. A process according to claim 1, wherein the anionic particles are added to the suspension in an amount of at least 0.01 kg per ton, calculated as dry on dry fibers and optional fillers.

12. A process according to claim 1, wherein the produced products in sheet or web form are paper.

* * * * *